US010991358B2

(12) United States Patent
Sheng et al.

(10) Patent No.: US 10,991,358 B2
(45) Date of Patent: Apr. 27, 2021

(54) LOW FREQUENCY ACOUSTIC ABSORPTION AND SOFT BOUNDARY EFFECT WITH FREQUENCY-DISCRETIZED ACTIVE PANELS

(71) Applicants: The Hong Kong University of Science and Technology, Hong Kong (CN); Hong Kong Baptist University, Hong Kong (CN)

(72) Inventors: Ping Sheng, Hong Kong (CN); Zhen Dong, Hong Kong (CN); Xiaonan Zhang, Hong Kong (CN); Jie Pan, Hong Kong (CN); Ho Yiu Mak, Hong Kong (CN); Guancong Ma, Hong Kong (CN)

(73) Assignees: THE HONG KONG UNIVERSITY OF SCIENCE AND TECHNOLOGY, Hong Kong (CN); HONG KONG BAPTIST UNIVERSITY, Hong Kong (CN)

( * ) Notice: Subject to any disclaimer, the term of this patent is extended or adjusted under 35 U.S.C. 154(b) by 0 days.

(21) Appl. No.: 16/731,376

(22) Filed: Dec. 31, 2019

(65) Prior Publication Data

US 2020/0211527 A1 Jul. 2, 2020

Related U.S. Application Data

(60) Provisional application No. 62/917,821, filed on Jan. 2, 2019.

(51) Int. Cl.
*G10K 11/178* (2006.01)
*H04R 1/40* (2006.01)
(Continued)

(52) U.S. Cl.
CPC .. *G10K 11/17854* (2018.01); *G10K 11/17873* (2018.01); *H04R 1/403* (2013.01);
(Continued)

(58) Field of Classification Search
None
See application file for complete search history.

(56) References Cited

U.S. PATENT DOCUMENTS

2003/0023430 A1* 1/2003 Wang ..... G10L 25/78 704/226
2006/0251267 A1* 11/2006 Ohnishi ..... E01F 8/0094 381/71.1

(Continued)

*Primary Examiner* — Qin Zhu
(74) *Attorney, Agent, or Firm* — Nath, Goldberg & Meyer; Jerald L. Meyer; Stanley N. Protigal

(57) ABSTRACT

An active sound barrier has at least one passive sound absorber at or near a boundary location. A microphone provides an output to a frequency division module, in which a plural of frequencies are filtered to provide outputs corresponding to frequency segments of the receiving transducer output at respective ones of the frequencies. An active driving circuit drives plural speakers or output transducers at respective ones of the frequencies, with at least a subset of the speakers or output transducers at or close to the barrier. The speakers or output transducers cooperate with the passive sound absorber to reduce noise across a wide frequency band as well as to effect an electrically switchable soft boundary.

17 Claims, 6 Drawing Sheets
(6 of 6 Drawing Sheet(s) Filed in Color)

(51) Int. Cl.
*H04R 3/12* (2006.01)
*G10K 11/172* (2006.01)

(52) U.S. Cl.
CPC ..... *H04R 3/12* (2013.01); *G10K 2210/3028* (2013.01); *G10K 2210/3215* (2013.01); *G10K 2210/3224* (2013.01)

(56) References Cited

U.S. PATENT DOCUMENTS

| | | | | |
|---|---|---|---|---|
| 2007/0223714 | A1* | 9/2007 | Nishikawa | G10K 11/178 381/71.1 |
| 2008/0187147 | A1* | 8/2008 | Berner | G10K 11/178 381/71.3 |
| 2015/0027805 | A1* | 1/2015 | Tsai | B29D 22/003 181/199 |
| 2015/0078563 | A1* | 3/2015 | Robertson | G10K 15/08 381/63 |
| 2016/0014500 | A1* | 1/2016 | Takano | H04R 1/288 381/354 |
| 2016/0157032 | A1* | 6/2016 | Kane | G08B 25/016 381/56 |
| 2018/0352331 | A1* | 12/2018 | Kriegel | H04R 3/12 |

* cited by examiner

LOW FREQUENCY ACOUSTIC ABSORPTION AND SOFT BOUNDARY EFFECT WITH FREQUENCY-DISCRETIZED ACTIVE PANELS

RELATED APPLICATION

The present Patent Application claims priority to Provisional Patent Application No. 62/917,821 filed Jan. 2, 2019, which is assigned to the assignee hereof and filed by the inventors hereof and which is incorporated by reference herein.

BACKGROUND

Technical Field

This disclosure relates to active noise reduction (ANR) and sound absorption. More particularly, the disclosure relates to sound absorbing panels and soft boundaries using active wall panels.

Background Art

Sound propagates through air adiabatically with little loss. Conventionally, in sound absorption materials dissipation is mainly localized at solid-air interface, through relative motion within the viscous boundary layer, as well as through heat conduction through solid that leads to the breakdown of the adiabatic character of sound propagation. This basic nature of sound/noise dissipation dictates that most of the conventional sound absorption materials are porous in structure, e.g., acoustic sponge, rock wool, or glass wool, with a large surface to volume ratio so that there can be a large dissipation coefficient. The total absorption depends on the product of dissipation coefficient with the energy density; hence during the past decade there has been a surge of interest in using acoustic metamaterials for sound absorption. This is because many of the novel properties of acoustic metamaterials arise from local resonances, which can give rise to large energy densities and hence efficient energy dissipation. In particular, acoustic metamaterials can absorb at low frequencies with extremely thin sample thicknesses, a feat that is beyond the reach of traditional absorbers.

Both the traditional porous absorbers and the acoustic metamaterial absorbers have drawbacks. Whereas the traditional absorbers have fixed absorption spectrum which can only be adjusted by varying the sample thickness, acoustic metamaterials have an issue in having an inherently narrow frequency band of operation, owing to the local resonances responsible for metamaterials' exotic properties. For example, while acoustic metamaterial can absorb almost perfectly at low frequencies with a very thin sample thickness, the absorption peak is inherently very narrow; i.e., extraordinary absorption is achieved only at a particular design frequency. This conflicts with the fact that, in most applications, broadband absorption is usually a necessity.

For traditional absorbers, low frequencies always constitute a problem since bulky samples are required for high absorption, which can be impractical in many applications.

SUMMARY

An active sound barrier is provided at a barrier, in which the barrier comprises a defined boundary location. At least one passive sound absorber is provided at or near the boundary location. A microphone or sound receiving transducer provides a receiving transducer output to a frequency division module, in which the frequency division module comprises a filter circuit filtering a plurality of frequencies. The filter circuit provides outputs corresponding to frequency segments of the receiving transducer output at respective ones of the frequencies, and an active driving circuit output receives the outputs at respective ones of the frequencies. A plurality of speakers or actuators and output transducers receive driving signals from the active driving circuit to provide active noise reduction at the respective ones of the frequencies. At least a subset of the output transducers are at or near barrier. The plurality of speakers or output transducers cooperate with the passive sound absorber to reduce broadband noise as well as to effect an electrically switchable soft boundary.

BRIEF DESCRIPTION OF THE DRAWINGS

The file of this patent contains at least one drawing executed in color. Copies of this patent with color drawing (s) will be provided by the Office upon request and payment of the necessary fee.

FIG. 2A is a schematic diagram showing the passive sound absorber. FIG. 2B is a corresponding photograph of the sound absorber shown in FIG. 2A. FIG. 2C is a graphic depiction of a surface impedance curve without an acoustic sponge over the sound absorber of FIGS. 2A and 2B. FIGS. 2D and 2E are pressure diagrams showing full waveform simulation of the evanescent wave's lateral pressure difference at an anti-resonance frequency, which is a frequency located between resonance frequencies of two FP channels, denoted as left (red) and right (blue) shaded squares in FIG. 2D.

FIGS. 6A-6D are color spectrographic maps showing pressure gradients. FIG. 6E is a graphical depiction of frequency response for the panel generating the pressure gradients of FIGS. 6A-6D.

DETAILED DESCRIPTION

Overview

Figure 1:
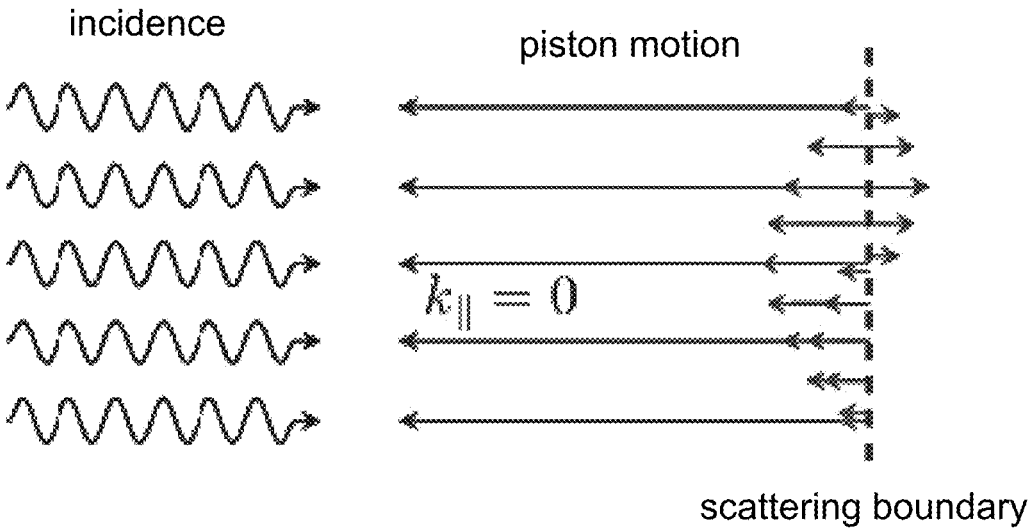
FIG. 1 is a schematic diagram illustrating the active wall panel with discretized moving segments that responds to the incident sound wave.

The present technology is directed to an active system comprising discretized panels each moving at a fixed frequency in response to the incident wave, that can effect total absorption as well as soft boundary.

It is often desired to attain broadband and tunable absorption and to tune boundary impedance characteristic through integration of discrete resonators. When a sound or electromagnetic wave is incident on the surface of a structure or material, there will be a response in the form of a reflected wave plus a wave penetrating into the structure or material. Such wave response must be causal in character, i.e., the wave response at any given moment can only depend on what happened before that moment. This is called the causal principle. In other words, future waves cannot affect the response now.

When expressed in mathematical language, this intuitive and seemingly trivial statement can have profound implications that cut across almost all areas of physics. In the 1920's, two physicists, Hans Kramers and Ralph Kronig, independently derived from the causal principle a relationship between the real and imaginary parts of the electromagnetic dielectric function which is now called the Kramers-Kronig relation, which is considered basic knowledge in the field of electrodynamics. A much less known implication of the causal principle is the inequality linking the sample thickness to the electromagnetic wave absorption spectrum. The present disclosure derives the acoustic version of this causal constraint, which has the following form:

$$d \geq \frac{1}{4\pi^2}\frac{B_{eff}}{B_0}\left|\int_0^\infty \ln[1-A(\lambda)]d\lambda\right| = d_{min}, \tag{1}$$

where $$\lambda = \frac{2\pi v_0}{\omega}$$

denotes the sound wavelength in air, $v_0$ is the speed of airborne sound, $\omega$ is the angular frequency, $A(\lambda)$ is the absorption spectrum, $B_{eff}$ is the effective bulk modulus of the sound absorbing structure at a static limit, and $B_0$ is the bulk modulus of air.

One can interpret equation (1) to mean that for a given sample thickness d, there is a limited amount of absorption resources that is given by the integral indicated by the right-hand side of equation (1). For an absorption spectrum that is centered at low frequencies, the required amount of sample thickness is much more than if the same frequency width of the absorption spectrum is centered at a higher frequency.

Equation (1) essentially addresses the first question posed above, by addressing the issue of an ultimate lower bound on sample thickness for a particular wave absorption spectrum. For absorption of low-frequency audible range of sound, e.g., 20-400 Hz, the required minimum thickness (d>15 cm) of the absorber can be too large for its use in a wider range of applications. The disclosed technology breaks the limit of low-frequency absorber's thickness by adopting an active part into the disclosed integration designing strategy of broadband sound absorber. These frequency ranges and thicknesses are given as non-limiting examples, as other ranges may apply. By way of non-limiting example, the frequency ranges can comprise frequencies lower than 20 Hz, and can comprise frequencies up to 600 Hz or up to 800 Hz. It is of course also possible to provide such frequency response up to and beyond the normal range of human hearing.

From past experience, two questions naturally arise. First, is there an ultimate lower bound on sample thickness for a particular wave absorption spectrum? Second, can one broaden the absorption frequency spectrum of acoustic metamaterials by integrating multiple local resonators operating at different frequencies? One recent breakthrough in research has occurred that answered both questions in the affirmative. Absorption metamaterials which present wider response bands have been commercialized by the Acoustic Metamaterials Group, of Hong Kong, using Fabry-Pérot resonators-based passive sound absorbers.

An integration scheme of designing broadband absorption has recently been proven very successful in tailoring the absorption spectrum to the noise spectrum. Broadband absorption has also been successfully realized commercially through the mass production of Fabry-Pérot resonator-based passive sound absorbers based on the integration scheme such as those produced by Acoustic Metamaterials Group.

This disclosure provides an active acoustic metamaterial wall panel that can absorb broadband sound, including a broadband low frequency sound component, with tunable acoustic functionalities. The incoming sound collected by a microphone goes into a filtering circuit in which $n^2$ distinct predetermined single-frequency components are selected to conform with the target broadband absorption spectrum. The $n^2$ signals are adjusted to be in-phase with their same frequency counterparts of incident source and fed into an active unit comprising an n×n array of individually active panel segments, in which n is an integer value. Each segment comprises a miniature speaker/actuator and a mechanical resonator excited by the actuator to produce low-frequency sound waves with low distortion and large dynamic range.

Each segment's motion is at a fixed frequency. The motions of the $n^2$ segments are divided into two components. The area-averaged motion over all of the segments, denoted the piston mode, contributes to propagating waves. The motions with the area-averaged component subtracted out, constitute the other component, characterized by $\sim n^4$ emergent additional frequency components resulting from the lateral interaction between different segments' motions, which can be effective in smoothing the absorption spectrum. Simultaneously tuning $n^2$ segments' motion amplitudes can shift the functionality from a hard wall→total absorber→soft boundary, as well as anything in-between.

Discrete Resonators' Frequency Selection Strategy

In the idealized case of having available a continuum of resonances, the optimal choice of resonance frequencies for achieving the target impedance spectrum z(f) is shown to satisfy a simple differential equation, given by:

$$\frac{df}{d\bar{n}} = 2\phi\frac{Z(f)}{Z_0}f \tag{2}$$

where $\phi$ is the fraction of surface area occupied by the resonators, $Z_0$ is the air impedance, and $\bar{n}$ is a continuum linear index of the frequency, having a range of from 0 to 1.

For the disclosed active absorbers, an equivalent effect can be achieved through destructive interference, or so-called "coherent perfect absorption", or CPA. For total absorption at frequency f, one would like to have $Z(f)/Z_0=1$. A flat Z(f) implies an exponential solution for equation (2).

Suppose one can only select $n^2$ discrete frequencies, then what could be derived from equation (2) is that these frequencies should follow the selection rule of:

$$f_m=f_1(1+2\varepsilon)^{n^2-1} \tag{3}$$

where the parameter e is determined by the frequency range.

For example, if the lower limit is 50 Hz, the upper limit is 300 Hz and the total number of discrete frequencies is 9, then ε must satisfy the equation:

$$300=50(1+2\varepsilon)^8 \tag{4}$$

Breaking the Causality Constraint by Using Active Wall Panels

FIG. 1 is a schematic diagram illustrating the active wall panel with discretized moving segments that responds to the incident sound wave. In accordance with the causality constraint, the absorption of broadband low frequency sound is necessarily associated with thick samples that may not be suitable for most applications. In order to break this constraint, the present disclosure proposes the use of active wall panels, comprising independently moving segments, each actuated at a fixed frequency whose amplitude and phase are adjusted in reference to the same frequency component of the incident sound wave.

Lateral dimension of a single unit of the active panel should be subwavelength in the relevant frequency range of consideration for the disclosed technology. A significant aspect of the active panel is the division of the segmented panels' motion into two components. One component, denoted the piston component, represents the area-averaged (over all the segments in a single unit) motion of the panel. It is possible to construct the panel such that the piston is the only component that couples to the propagating incident and reflected waves. The evanescent waves constitute the other component, which does not couple to the propagating waves. Instead, evanescent waves decay exponentially away from the active panel.

To show the coupling/non-coupling nature of the two components, the use of wave vector $\vec{k}$ and frequency $\omega=2\pi f$ are used for acoustic wave characterization. Let $k_{\parallel}$ and $k_{\perp}$ denote the acoustic wave vectors which are parallel and vertical to the active panel/scattering boundary, respectively, and they must obey the dispersion relation:

$$k_{\parallel}^2+k_{\perp}^2=\left(\frac{2\pi}{\lambda}\right)^2. \tag{5}$$

When the segments of the panel are in motion, the subwavelength scale means that except for the $k_{\parallel}=0$ component, which is exactly the piston mode, other modes would satisfy the following condition:

$$k_{\parallel}>\frac{2\pi}{2d}>>\frac{2\pi}{\lambda}. \tag{6}$$

Hence from the dispersion relation it follows that such modes must have $k_{\perp}^2<0$ which implies that $k_{\perp}$ is purely imaginary, i.e., these modes are evanescent in nature. For the $k_{\parallel}=0$ component, on the other hand, $k_{\perp}$ is real and hence can couple/interact with the propagating incident and reflected waves.

The physics of the evanescent waves means these waves can only exist in the in the vicinity of active wall, and the relevant air pressure modulations are along the horizontal/lateral directions. In the vertical direction, the wave amplitude decays exponentially and there is no energy flow along this direction. The very nature of the evanescent waves means that they cannot propagate to the far field. In contrast, the piston mode of the active panel's motion satisfies:

$$k_{\parallel}=0, \quad k_{\perp}=\frac{2\pi}{\lambda}. \tag{7}$$

This is the only component of the active wall that couples to the incident and reflected waves.

Evanescent Waves in Sound Absorption

Figure 2A:
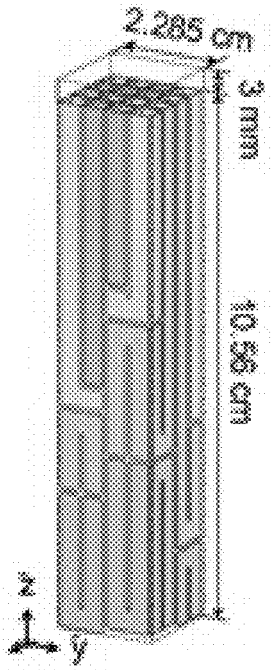
FIGS. 2A-2E are diagrams showing Fabry-Pérot resonator-based passive sound absorbers.
Figure 2B:
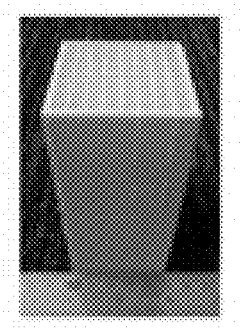
Figure 2C:
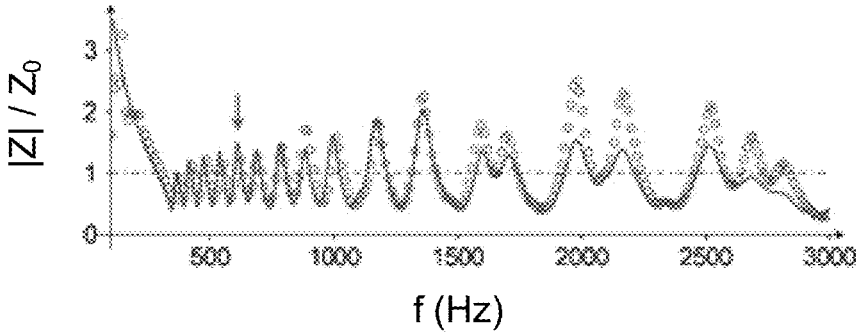
Figure 2D:
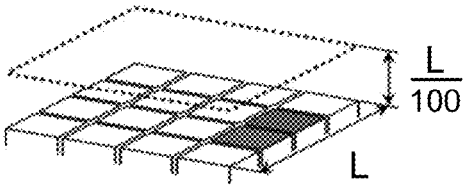
Figure 2E:
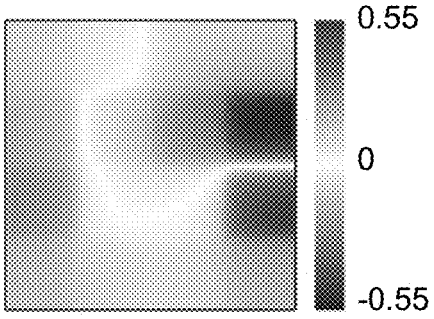

FIGS. 2A-2E are diagrams showing Fabry-Pérot resonator-based passive sound absorbers. FIG. 2A is a schematic diagram showing the passive sound absorber. FIG. 2B is a corresponding photograph of the sound absorber shown in FIG. 2A. FIG. 2C is a graphic depiction of a surface impedance curve without an acoustic sponge over the sound absorber of FIGS. 2A and 2B. FIGS. 2D and 2E are pressure diagrams showing full waveform simulation of the evanescent wave's lateral pressure difference at a surface very close to the channel mouths. The pressure difference in FIGS. 2D and 2E are taken at an anti-resonance frequency, which is a frequency located between resonance frequencies of two FP channels, appearing as the left (red) and right (blue) shaded squares, in FIG. 2D. The selected frequency indicated in FIG. 2C by the arrow over approximately 600 Hz. From Darcy's law, such lateral pressure difference, oscillating in time, can induce oscillating lateral air flow, thereby dissipating sound energy when such flow occurs in a porous medium such as the acoustic sponge.

Although the above analysis shows that evanescent waves do not contribute to the propagating sound field, they do contribute to horizontal energy flows near the scattering boundary, like that shown in FIGS. 2D and 2E. By utilizing this feature, the Fabry-Pérot resonator-based passive sound absorbers can achieve a very good broadband sound absorption when a thin layer of acoustic sponge is placed on top of the absorption unit. In this structure, the lateral air flows inherent to the evanescent waves, now occurring inside a dissipative medium (acoustic sponge), can effectively dissipate the sound energy at those frequencies intermediate between the resonances.

Active Absorber Panel Based on Frequency-Discretized Active Segments

The disclosed technology uses two significant elements to attenuate sound. One is to achieve a broadband response by decomposing incident sound wave's continuous time domain signal into discretized single frequencies, with the frequency selection to be dictated by the integration scheme given by equation (2). These discrete frequency components (with the amplitude and phase given by the incident wave decomposition) are to be used, in the form of electrical signals, to actuate individual segments of the active panel. The other element is the utilization of evanescent waves' oscillating lateral air flows for sound energy absorption. The oscillating lateral air flows must occur as the consequence of the non-coherent movements of the different segments in the panel. It is desired to maximize such sound absorption by using a dissipative medium, e.g., acoustic sponge, in the vicinity of the active panel. It should be noted that in the context of absorption, the oscillating lateral air flows can have many frequency components that differ from the frequencies of the segments, thereby filling in the frequency gaps inherent to the discretization scheme.

There are several advantages to the present active design. First, the decomposition of the input time series signal into frequency components is a simple frequency filtering or Fourier transform process, which can be accomplished either by hardware, either by analog L-C circuitry or digital processing circuitry, performing Fast Fourier Transform (FFT). There is no feedback required as in most active acoustics schemes. Second, there is no need for expensive speakers that must respond quickly to real-time control. Here the active components are each at a single frequency so that resonator can be used to amplify the input actuation signal at that frequency. That is; a large dynamic range can be achieved at low cost. Third, the geometry is a flat panel so that it can be used in large areas for sound manipulation in large spaces. Fourth, the utilization of evanescent waves can make the absorption spectrum nearly uniform and broadband.

Figure 3:
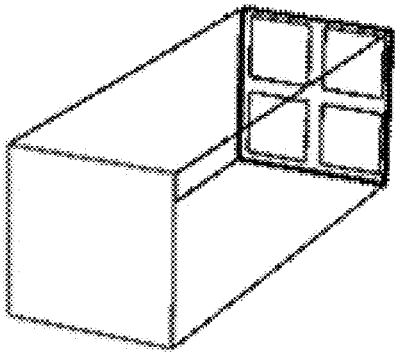
FIG. 3 is a schematic diagram illustrating simulation geometry using a COMSOL simulation model.

To illustrate the concept of design, a simulation model is set-up in the FEM software COMSOL Multiphysics program. The geometry of the model is shown in FIG. 3. FIG. 3 is a schematic diagram illustrating simulation geometry using a COMSOL simulation model. The four segments of the square in the back are each actuated at a fixed frequency with the amplitude and phase referenced to the same frequency component of the incident sound wave.

In this model, four arbitrary discrete frequencies are chosen, denoted by $f_1$, $f_2$, $f_3$, $f_4$ respectively, as the decomposition frequencies (not in accordance with the integration scheme as given by equation (2)), and the four unit panels of the active wall (as modelled) will move in accordance with these four single frequency values. To simplify the simulations, the incident wave composed by the same four frequency components are used.

Figure 4:
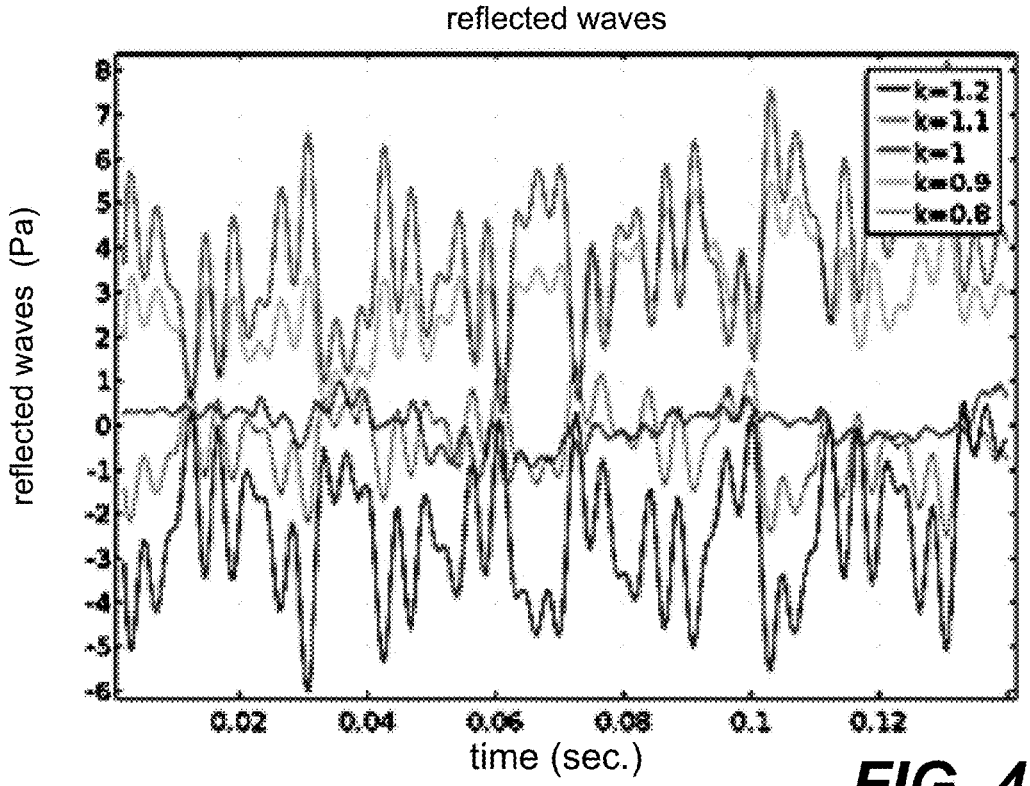
FIG. 4 is a graphic diagram of COMSOL results showing pressure modulations in time domain at a far-field surface in response to an arbitrary far-field plane wave source, with varied amplitudes of the active wall, tuned by varying a value k that can tune the area-averaged amplitude of the moving segments.

FIG. 4 is a graphic diagram of COMSOL results. The diagram shows pressure modulations in time domain at an arbitrary far-field surface, with varied amplitudes of the active wall, tuned by varying K. For K=1, the piston component of the active panel is completely in-phase with the incident wave, with the same time-domain amplitude variation. When that happens, the incident wave is completely absorbed (no reflection) because the incident acoustic pressure is doing work on the moving panel. For K<1, the reflection approaches that of a hard wall with decreasing K. For K>1, the reflected wave is seen to change sign; i.e., behaves as a mirror image of the reflected wave for K<1. In other words, this establishes a "soft" wall behavior where the reflection acquires a sign change from that of hard wall reflection.

Since only the piston-like component of the motions contributes to the far field, the actuated amplitude of each segment's motion must be $1/\varphi$ times the amplitude of same frequency component in the incident wave, where $\varphi$ denotes the area fraction of that segment in the active panel unit. Only by doing so would the piston motion can have the correct amplitude that corresponds to the amplitude of the same frequency component in the incident wave. If the active panel has $n^2$ segments, then the amplitude of each segment's motion would be roughly $n^2$ times that of incident wave's amplitude for that particular frequency component. Such large amplitudes would imply very strong lateral flows induced by the evanescent waves.

In order to vary the piston component's motion amplitude, the strength of the actuation signals for all the segments will be simultaneously tuned by a multiplying factor K. In the simulations, the phases of the four units are pinned to be exactly the same as their counterparts in the incident wave's components, and the tuning factor K is varied so as to see how the reflection changes in the time domain. In essence, the factor K tunes the amplitude of the piston mode.

In FIG. 4, K=1 denotes that the amplitude of the active wall's piston component's motion is the same as that of the incident wave and they are also in phase. The time domain curves clearly show that when K=1 there is almost no pressure modulations and therefore no reflected wave, implying total absorption. When the amplitude of the active wall exceeds K=1, a phase change emerges and the active wall is tuned to be a soft acoustic boundary. Therefore, for all single frequency values where active walls match with the incident wave, in-phase motion of the active walls can act as a perfect absorber or a soft boundary depending on the amplitude of the piston component.

Figure 5:
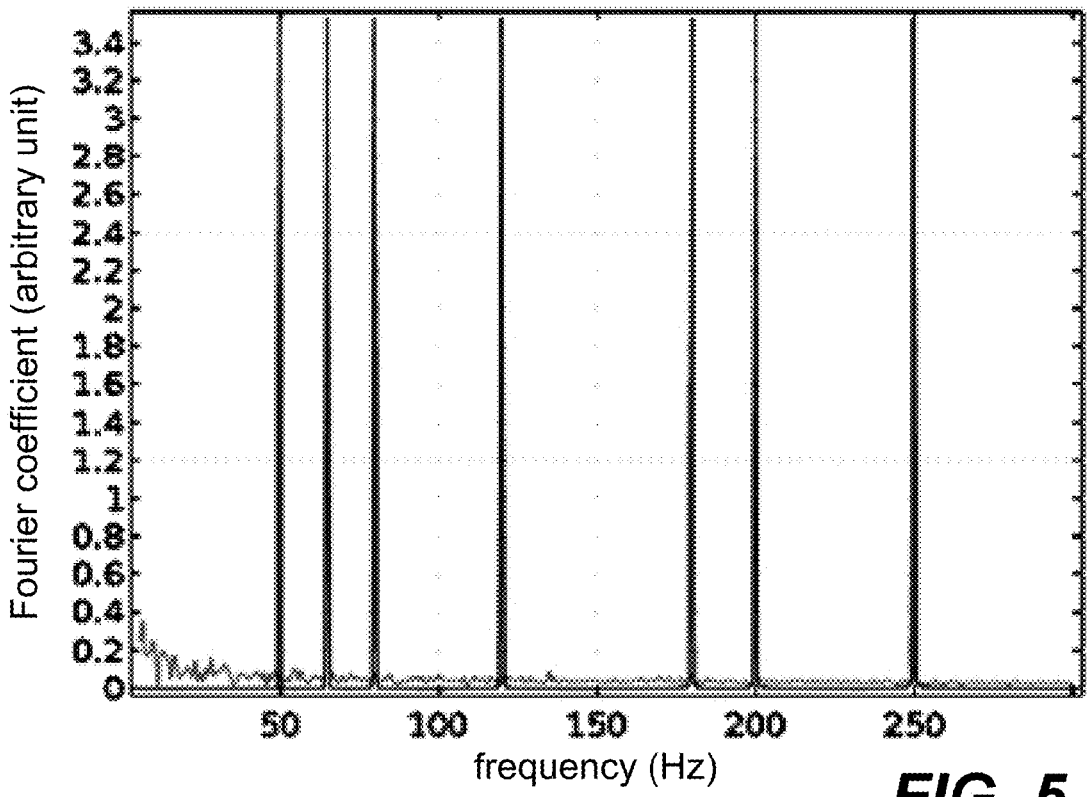
FIG. 5 is a graphic diagram of COMSOL results showing the frequency domain components of the reflective wave when three interpolated single frequency components are added into the incident wave.

FIG. 5 is a graphic diagram of COMSOL results showing the frequency domain components of the reflective wave and incident wave when three interpolated single frequency components are added into the incident wave. The three interpolated single frequency components into the incident waves are denoted by $f_{12}$, $f_{23}$, $f_{34}$.

The three interpolated single frequency components do not correspond with the previous four frequencies, causing an interaction between the active wall and incident waves at seven single-frequency incident components in total. The active wall remains to have the same four units as before, with frequencies $f_1$, $f_2$, $f_3$, $f_4$. FIG. 5 gives the frequency domain components by doing Fourier transform of the reflective wave under this circumstance, at k=1, in which green curves are frequency components of the reflected wave while blue ones are that of the incident wave. It is seen that in this case, 3 reflected wave peaks appear at those three interpolated frequencies, meaning that the interpolated frequencies are completely reflected.

To absorb those incident frequency components that are intermediate between the chosen discrete frequencies on the active panel, the evanescent waves that give rise to lateral air flows are used as a way of dissipating sound energy. Simulations results have shown such lateral air flows can have many frequency components intermediate between the chosen discrete frequencies, which would facilitate the absorption of such intermediate frequency components. In fluid dynamics, the energy dissipated by a fluid flow is given by $E=\frac{1}{2}Q\nabla p$, where Q denotes the flow rate that is in-phase with the oscillating pressure gradient, and $\nabla p$ denotes the lateral pressure gradient. Since Darcy's law states that $Q=(K/\eta)\nabla p$, where $\kappa$ is the permeability and $\eta$ is viscosity, it follows that the energy dissipation can be evaluated as:

$$E = \frac{1}{2}\frac{\kappa}{\eta}\left|\nabla p\right|^2, \tag{8}$$

Based on equation (8), calculations are carried out based on the results of COMSOL model simulations, with the goal to seek the square of lateral pressure gradient, i.e., $|\nabla p|^2$, on the surface of the active panel.

Figure 6A:
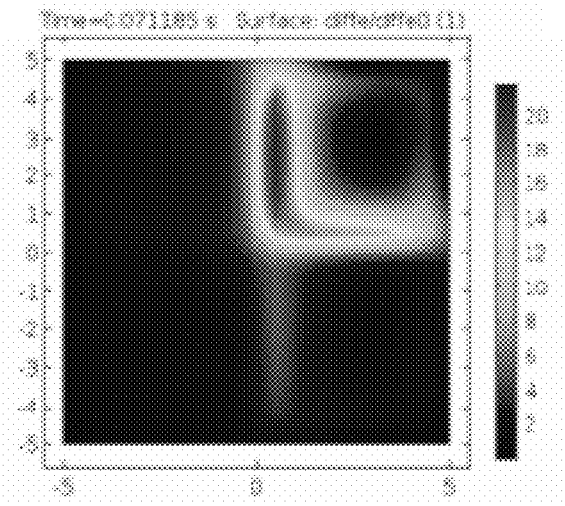
FIGS. 6A-6E are COMSOL simulation results showing the lateral air pressure gradient in the vicinity of the active panel's surface.
Figure 6B:
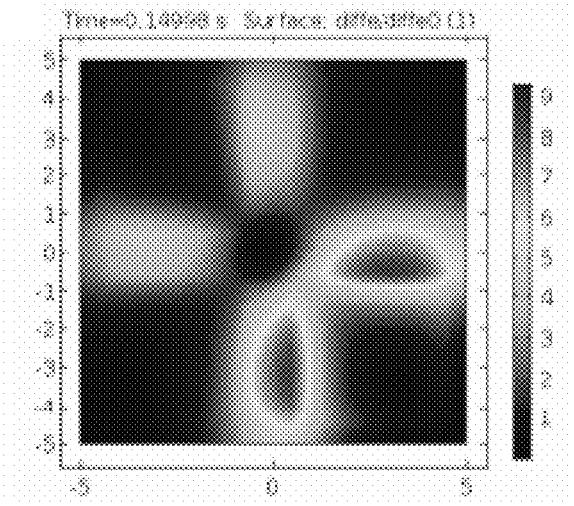
Figure 6C:
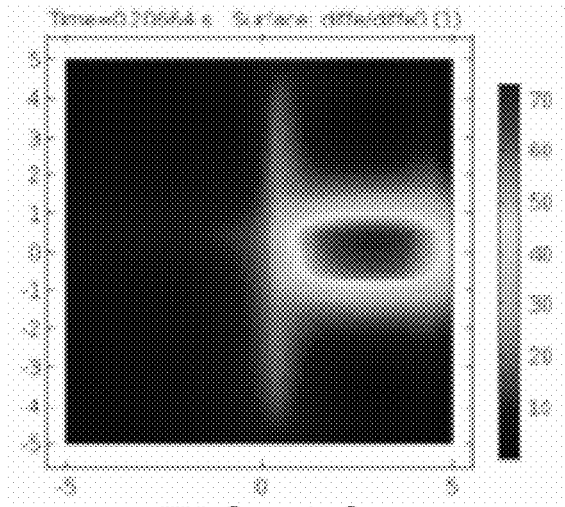
Figure 6D:
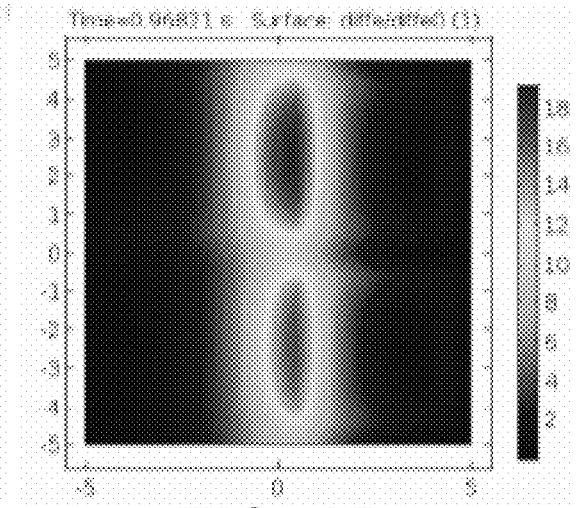
Figure 6E:
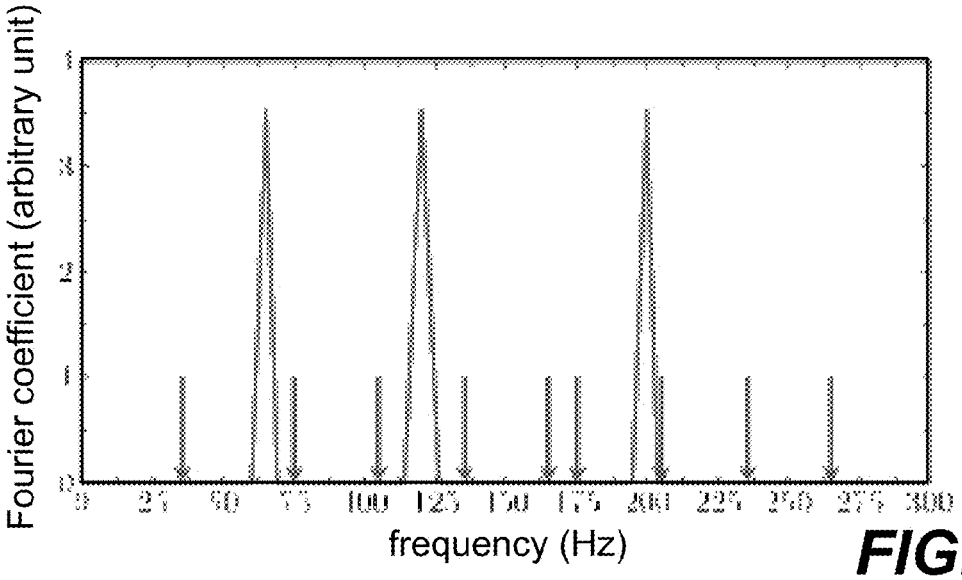

FIGS. 6A-6E are COMSOL simulation results showing the normalized lateral air pressure gradients squared, in the vicinity of the active panel's surface. FIGS. 6A-6D are color spectrographic maps showing normalized lateral pressure gradients squared. FIG. 6E is a graphical depiction of frequency response for the panel generating the lateral pressure gradients of FIGS. 6A-6D.

The depiction of FIGS. 6A-6D show normalized lateral pressure gradients squared, normalized by the square of the maximum pressure gradient in the incident wave, taken at four arbitrarily chosen time points consistent with the interception or incidence of sound waves. The graphical depiction of FIG. 6E gives frequency domain components of the lateral gradients, which are indicated by the vertical arrows. Here for the 2×2 array, there are a total of 14 frequency components, with 5 beyond the 300 Hz range.

The color spectrographic maps of FIGS. 6A-6E are based on the dimensionless parameter $$|\nabla p_{lateral}|^2 / \left(\frac{p_0}{\lambda_0/4}\right)^2.$$

For each of the four arbitrarily chosen points in the time domain, lateral air flows can be identified by color in those diagrams. The normalizing factor $$\left(\frac{p_0}{\lambda_0/4}\right)^2$$

denotes the maximum pressure gradient of the incident wave. It is seen from FIGS. 6A-6D that the lateral pressure gradient squared $|\nabla p|^2$ can be much larger than the maximum value in the incident wave. Hence, from equation (8), significant energy dissipation can be expected if the air flows through an acoustic sponge, which gives a large value of $$\frac{\kappa}{\eta},$$

placed in the vicinity of the active panel. To check the frequency domain behavior of these lateral flows, a Fourier transform result is shown in FIG. 6E. Compared to the three interpolated frequency components in the incident wave, there are many more lateral flow frequencies, of which many can nearly coincide, or close to, the interpolated frequencies. This means when an acoustic sponge is placed on top of the active panel, the lateral flows can absorb the intermediate frequencies, leading to a broadband absorption spectrum.

Since the lateral flows/dissipations result from interactions between active wall segments with different frequencies, the number of frequency components for the lateral flow should increase roughly as $n^4$, where $n^2$ is the number of segments within the active panel unit. Hence a broadband absorption spectrum might be expected if a unit's segment number increases to 9, based on a 3×3 array.

The result is that, by designing an active wall with segmented wall units moved independently (each at a single frequency), with a thin layer of acoustic sponge placed on its surface, one can achieve the following functionalities:

(1) Broadband near-total sound absorption of the incident sound wave, where total absorption at selected frequencies are effected by the incident wave doing work on the active wall when it is moving in-phase with the incident wave, and the absorption at other frequencies is effected by the lateral air flows of the evanescent waves. The net result is a broadband, rather smooth total absorption spectrum.

(2) By increasing the amplitude of the piston component by tuning the K value to beyond 1 (K>1), soft boundary effect can result for the active panel's frequency components.

(3) By tuning the K value continuously between 0 and 2, one can adjust the active panel to exhibit hardwall reflection, less than hardwall reflection, total absorption, complete soft boundary with near-zero impedance, or soft boundary with impedance between zero and that of air.

Analog L-C Circuitry

In an initial approach, analog L-C circuitry was used to establish an L-C circuitry based tunable panel. In that configuration, the shift of the panel's function from a sound absorber to a soft acoustic boundary is realized by tuning the active parts' phases from completely out-of-phase with the sound source to completely in-phase.

Later simulations showed that another technique, which may be more convenient and effective, in which one can maintain the phase as always in-phase with that of the sound source. The phase is maintained in-phase with the sound source, by adjusting the active parts' amplitudes (which is tuning K from K>1, to K=1, and to K<1, similar to the manner described in previous sections), the panel's acoustic behavior would vary from soft boundary (K>1), to absorber (K=1), and to hard wall (K<1). In this part of analog L-C circuitry, the tuning scheme should be in this way, not as the original one of tuning phase from in-phase (constructive) to out-of-phase (destructive).

In a non-limiting example, the active modules take the functional form of spring-mass resonators driven by miniature speakers or actuators as opposed to the form of piezo electric speakers as proposed initially.

As a whole, the analog L-C circuitry should serve as an alternative means of hardware component to the FFT computation part/digital circuitry described earlier, so all other components of the invention should remain consistent no matter whether FFT circuitry or L-C analog circuitry is chosen. For the analog L-C filtering approach, simulation results show that the output signal selected by the analog L-C circuitry agrees extremely well with the target signal in the input time series signal, which is shown below.

Figure 7A:
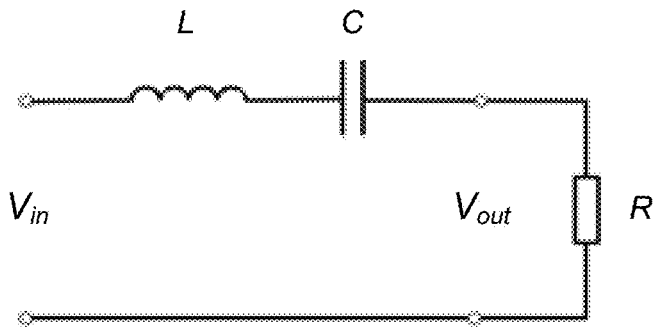
FIGS. 7A and 7B are a schematic diagram of an L-C circuit (FIG. 7A) and a graphic diagram (FIG. 7B) showing simulated time series of input and output signals.
Figure 7B:
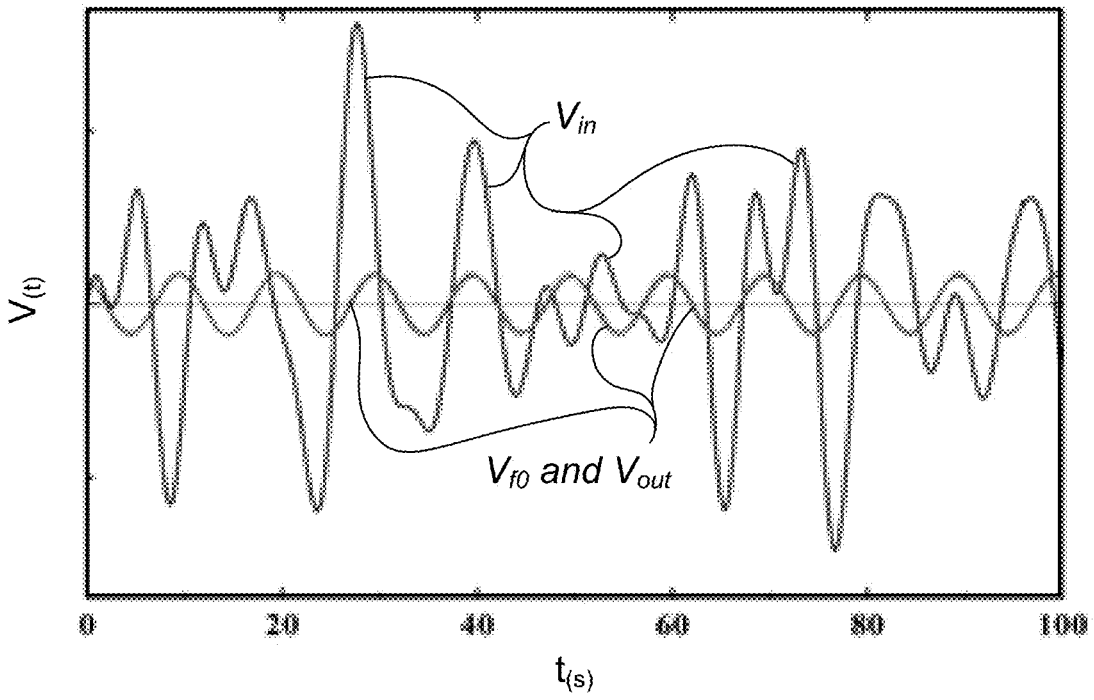

The resonance frequency of a classic L-C electrical circuit shown in FIG. 7A is denoted by $f_0=1/(2\pi\sqrt{LC})$. This L-C resonance circuit can filter out all the other frequency components in an input time series signal, leaving only the $f_0$ component to be the output signal, shown in FIG. 7B by the $V_{out}$ line. In FIG. 7B, the $V_{f0}$ line denotes the $f_0$ frequency component in the input time series signal $V_{in}$. It is seen that the agreement between the filtering result $V_{out}$ and the target source $V_{f0}$ is extremely good, with the same amplitude and no phase shift. Here the time series signal $V_{in}$ is generated by synthesizing 101 single frequency components, ranging from 5 Hz to 15 Hz with step of 0.1 Hz. $V_{in}$ is shown as the irregular large amplitude curve in FIG. 7B. Among the 101 frequencies, attention is given to the 10 Hz component, which is the $V_{f0}$ signal mentioned earlier.

For the L-C resonance circuit, the chosen parameters were:

$$1/(2\pi\sqrt{LC})=f_0=10 \text{ Hz and } \sqrt{L/CR^2}=200, \quad (9)$$

Since this is a linear electrical circuit, the output signal $V_{out}$ can be readily calculated. For an input signal component of frequency f (i.e. $V_{in}(f)$), the output signal is determined by the relation:

$$V_{out}(f) = A_m(f)\exp(i\theta(f)) \cdot V_{in}(f), \quad (10)$$

$$\text{where } A_m(f)^{-1} = 1 + \frac{L}{CR^2}\left(\frac{f^2 - f_0^2}{ff_0}\right)^2$$

and $$\theta(f) = -\arctan\sqrt{\frac{L}{CR^2}}\left(\frac{f^2 - f_0^2}{ff_0}\right), \quad (11)$$

For $f=f_0$, the frequency component of the L-C circuit's resonance, we have $A_m=1$ and $\theta=0$, which means the input $f_0$ component will not be changed (either the amplitude or the phase) by the L-C resonance circuit. For the other input frequency components, $A_m$ drops to zero quickly, implying that they will be filtered out. The simulated output time series signal is shown by the $V_{out}$ curve. It is seen that the $V_{out}$ and $V_{f0}$ curves agree very well with each other (being substantially superimposed), clearly showing that the L-C resonance circuit can serve as an analog filter to select out from the input time series signal the component with the desired frequency. Here the dimensionless factor $\sqrt{L/CR^2}$ is seen to act as the filter that controls the effectiveness of the frequency component selection. A higher $\sqrt{L/CR^2}$ factor would sharpen the filtering effect in frequency domain. One non-limiting example of a filter selection is $\sqrt{L/CR^2} \geq 200$.

To achieve a high value of the factor $\sqrt{L/CR^2}$ while maintaining the resonance frequency unchanged at $f=1/(2\pi\sqrt{LC})$, one effective approach is to have many L-C filters in series. If the L-C filters all have exactly the same values of L and C, then the resonance frequency would still be the same as a single L-C filter, but with a very sharp filtering effect; i.e., the in-series L-C filter circuitary would filter out almost all other frequencies except for $f_0$ and even components with frequency very close to $f_0$ would also be filtered out. Furthermore, if this constraint is relaxed of all single L-C filter being exactly the same, then the in-series filter circuitry as a whole would have a deviated resonance frequency from $f_0$, so this could be an approach to tune the overall filtering frequency, if L and C values are purposely chosen for some individual filters.

In the actual applications there should be n such L-C circuits in parallel, each with:

$$f_i = 1/(2\pi\sqrt{L_iC_i}), \quad (12)$$

and $$\sqrt{L_i/C_iR_i^2} = 200, \quad (13)$$

where $i=1, 2, \ldots, n^2$, in which $n^2$ is the total number of discretized active segments as previously described.

Prototype Configuration

Figure 8:
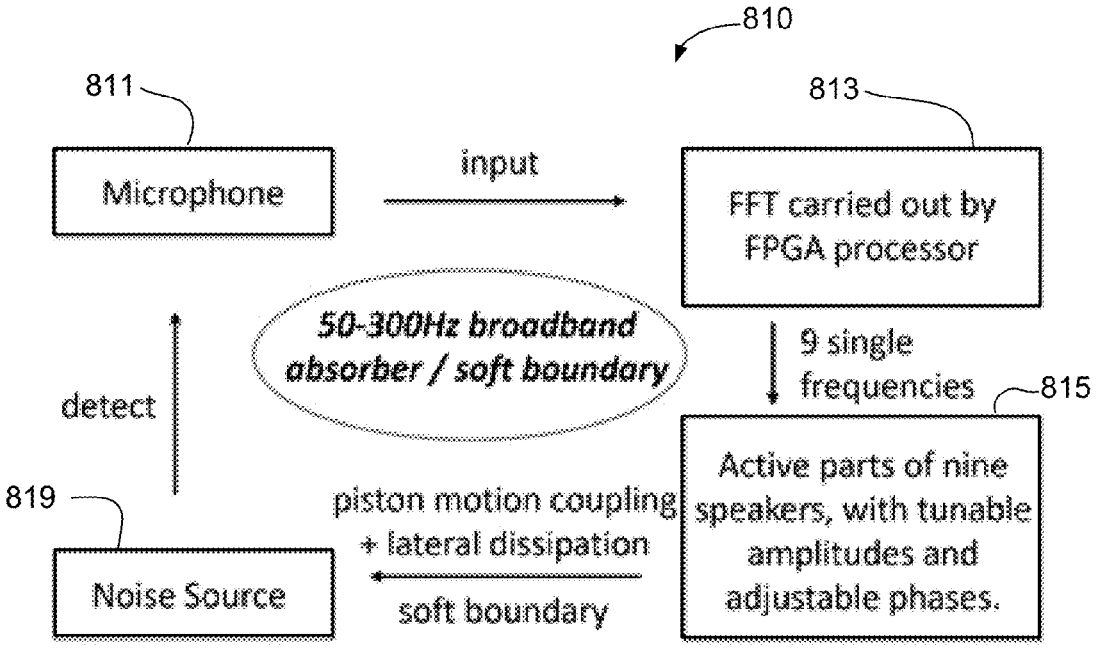
FIG. 8 is a schematic block diagram for a prototype configuration of an active sound absorber and soft boundary panel configured as a broadband absorber and soft boundary.

FIG. 8 is a schematic block diagram for a prototype configuration of an active sound absorber and soft boundary panel configured as a 50-300 Hz broadband absorber and soft boundary. Depicted are microphone 811, Field Programmable Gate Array (FPGA) processor 813 providing single frequency outputs, and amplifier and speaker outputs 815. In the non-limiting example, the FGPA performs fast Fourier transforms (FFT) for nine single frequency outputs, and a corresponding number of nine amplifier and speaker outputs are provided by amplifier and speaker outputs 815. Speaker outputs 815 reduce sound at noise source 819, by providing piston motion coupling and lateral dissipation in response to sound detected by microphone 811.

To put this design scheme into practice, an electronic circuit-based device was constructed, aimed at broadband sound absorption in the frequency range 50-300 Hz with a 3×3 array (n=3), as depicted in FIG. 8. A high-sensitivity microphone detects the incident noise signal and inputs it to the processing unit of the circuit. The electronic configuration of this processor is based on the Field Programmable Gate Array (FPGA) architecture and a Fast Fourier Transform (FFT) is carried out to output the selected nine single-frequency signals with frequency values determined by the integration scheme. These nine channels of signals feed the nine individual speakers. The nine speakers form a three by three array and serve as the actuators for the active wall units modeled in the precious COMSOL simulations. The dynamic range of each speaker is further amplified by using the actuating speaker to excite a resonator tuned to the selected frequency. Each speaker's sound is tuned so that its phase is the same as its counterparts in the incident wave. To tune the amplitude of the signal feed, one can silence all other frequency channels and adjust the feed signal strength until the final reflected wave from the resonating segment vanishes. The condition of K=1 is thereby achieved. By doing so for each frequency channel, one obtains a "correct" amplitude for each channel.

One major issue when making this first prototype is that at the low frequency range, it appears that one must rely on very expensive and large-sized speakers to produce loud and low-distorted sound. Since one goal of the design was making the device compact in size and low cost, the traditional approach was bypassed, and consequently, the use of large and expensive high-fidelity speakers was avoided.

Figure 9:
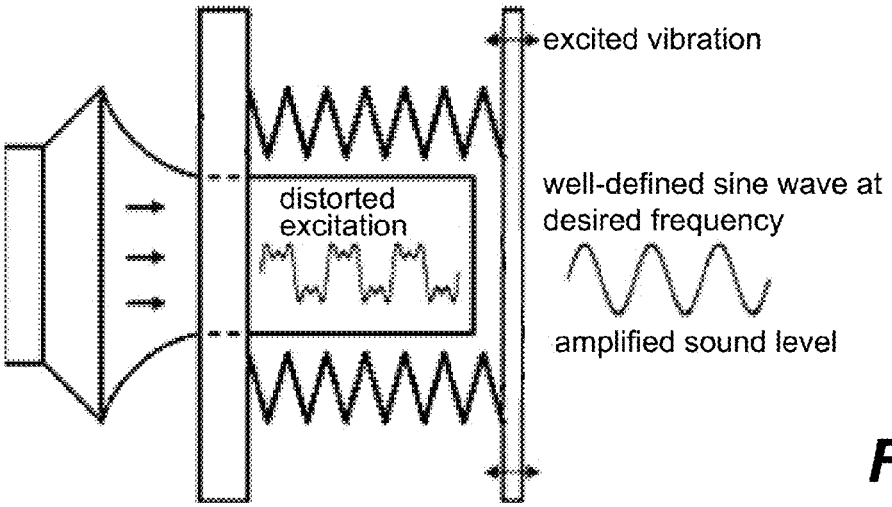
FIG. 9 is a schematic diagram showing how a spring-mass resonator is used in the prototype for the purpose of producing large amplitude, low-distorted, low-frequency sound.
Figure 10:
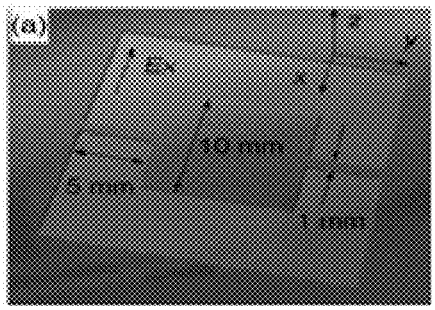
FIG. 10 is a photographic image of an electroplated flexural resonator, with a central mass plate suspended by two bridging springs.

FIG. 9 is a schematic diagram showing how a spring-mass resonator is used in the prototype for the purpose of producing large amplitude, low-distorted, low-frequency sound. FIG. 10 is a photographic image of an electroplated flexural resonator, with a central mass plate suspended by two bridging springs.

For anticipated mass production of the devices, the idea of using spring-mass resonators can be realized by other means. Specifically, this spring-mass resonator can be replaced a very thin metallic flexural plate resonator with a simple designed pattern and cut-outs, so that a movable part, with connections to a fixed frame, could be excited for vibrations at resonance. Similarly, piezoelectric transducers can be used.

Since the electronic filtering/modulation part can be separated from the microphone-speaker-feedback component, the dimension of one single panel would be fairly compact. By way of non-limiting example, the dimension of one single panel would be 10-20 centimeters in lateral size and only a few millimeters in thickness; however wide variations in dimensions are anticipated. Because of their compact physical dimensions, these switchable absorbers or soft boundaries can be modularized to fit specific application environments.

Use of the Active Panel as a Low Frequency Speaker

If the actuators' input originates from a stereo amplifier (instead from a microphone), then the active panel would act as a novel frequency-discretized low frequency speaker unit. In a non-limiting example, each active panel is a transducer or the equivalent of a speaker in the sense that "transducer" or "speaker" means a single-frequency resonant, segmented section in the active panel.

From FIG. 4 it could be seen that for the absorption performance, K=1 results in an effective impedance of the active wall that matches that of air, $Z_0$, as seen by the incident wave. Without the incident wave, here composed of four discrete frequencies, the active panel would act as a speaker unit that produces the sound time series that is exactly the reproduction of the (subtracted) incident sound wave. Suppose the stereo amplifier's input has a continuous frequency spectrum (instead of the four frequencies in the simulations), then in order to totally reproduce the whole range of the frequencies under consideration, it is important to select the frequency modes of the resonators in accordance with equation (2) and equation (3), and not arbitrarily as in the case of the simulation.

In other words, since the sound emission is just the same scenario without the incident wave, it follows that for the speaker, the same frequency selection rule should apply.

It is noted that such a speaker, with a multitude of segments each moving at a fixed frequency, can offer the flexibility of individually tuning each frequency component's amplitude. This is possible because each active segment's amplitude is amplified (from a small speaker whose output is expected to be weak) by a mechanical resonator tuned to that frequency; hence offering a very large dynamic range. Since woofers (and sub-woofers) are usually large and expensive, the frequency-discretized woofer can offer a low price alternative with flexibilities not present in the traditional woofers.

Features

While ANR using a microphone-speaker-feedback electronic system has been previously implemented, there is a necessity of "recognizing" the incoming waves, so that the active elements can respond with the appropriate responses. With recent advances in electronics and semiconductor industry, there are many consumer products based on this idea, such as ANR or active noise cancellation (ANC) headphones and earbuds, or active noise cancellation setups that can cancel the noise with any given spatial volume. These existing products typically rely on the power of smart chips as well as their high-fidelity speakers to achieve the broadband attenuation/cancellation, and usually a feedback loop is necessary to achieve the best result. Therefore, the manufacturing costs and prices remain high.

Compared to prior ANR or ANC products, the disclosed configuration of active sound absorber does not require smart chips for signal computation, because the disclosed incoming wave recognition process is analog in nature and extremely simple. No feedback loop is necessary. This simplicity is made possible by the frequency filtering and integration scheme in which the incoming sound signal, in the form of a time series, can be divided into a number of discrete frequencies, with the frequency selection from the input time series signal being realized by the very simple electrical L-C resonance circuit, or digital FFT processing circuit. Because of the spectrum broadening effect given by lateral air flows as well as dynamic range by using resonators, high-fidelity speakers are not needed.

The disclosed technology provides a compact, extremely thin profile, has low manufacturing cost, is economically feasible and can be mass produced for industrial grade ANC products which would have exceptionally wide applications on noise attenuation, such as in factories, designing of architectures, aircrafts, vehicle engines, and even many household appliances. The disclosed active absorbers will be especially useful for low frequency noise absorption, since by using active elements, it becomes possible to break the causality constraint on the thickness of the relevant absorber which is noted to be very large for low frequency absorption. The active absorber is designed to have substantially the same thickness for all low frequencies, which is a desired characteristic of the active absorber. Furthermore, by tuning the active segments' moving amplitudes, the device can also serve as an acoustic soft boundary, or an acoustic hard wall, or anything in between. The device could even serve as a new type of low frequency speaker with tunable frequency response and possibly lower cost.

CONCLUSION

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. An active sound barrier comprising:

a barrier comprising a defined boundary location;

at least one passive sound absorber at or near the boundary location;

a microphone or sound receiving transducer providing a receiving transducer output;

a frequency division module, the frequency division module comprising a filter circuit filtering a plurality of frequencies providing outputs corresponding to frequency segments of the receiving transducer output at respective ones of the frequencies, the filter circuit filtering a plurality of frequencies comprising $n^2$ parallel L-C circuits, the parallel L-C circuits configured to decompose an input voltage time series into $n^2$ predetermined frequency components, wherein n is an integer value, the $n^2$ pre-determined frequency components providing the outputs from the frequency selective filters to an active driving circuit;

the active driving circuit output receiving the outputs at respective ones of the frequencies; and a plurality of speakers or actuators and output transducers, the plurality of speakers or actuators and output transducers receiving driving signals from the active driving circuit to provide active noise reduction at the respective ones of the frequencies, at least a subset of said one or more output transducers at the barrier, adjacent the barrier or close to the barrier, the plurality of speakers or actuators and output transducers cooperating with the passive sound absorber.

2. The active sound barrier of claim 1, wherein the filter circuit filtering a plurality of frequencies comprising a digital FFT processing circuit configured to decompose the input voltage time series into the $n^2$ predetermined frequency components, the $n^2$ predetermined frequency components providing the outputs from the digital FFT processing circuit to the active driving circuit, wherein the active driving circuit drives at least one of the plurality of speakers or actuators and output transducers at multiple frequencies, and wherein the active driving circuit drives at least one of the plurality of speakers or actuators and output transducers at a single discrete one of the $n^2$ predetermined frequency components.

3. The active sound barrier of claim 1, wherein the active driving circuit drives at least one of the plurality of speakers or actuators and output transducers at multiple frequencies.

4. The active sound barrier of claim 1, wherein the active driving circuit drives at least one of the plurality of speakers or actuators and output transducers at a single discrete one of the $n^2$ predetermined frequency components.

5. The active sound barrier of claim 1, further comprising:

a passive sound-absorbing layer located at or near the defined boundary location; and at least a subset of the plurality of speakers or actuators and output transducers positioned at or near the sound-absorbing layer, wherein at least a subset of the plurality of speakers or actuators and output transducers have resonant frequencies for frequency selection at a lower frequency than a predetermined sound absorption frequency range of the sound-absorbing layer by itself.

6. The active sound barrier of claim 5, wherein the subset of the plurality of speakers or actuators and output transducers having at least a subset of resonant frequencies up to 800 Hz.

7. The active sound barrier of claim 5, wherein the subset of the plurality of speakers or actuators and output transducers having at least a subset of resonant frequencies up to 400 Hz.

8. Method of sound attenuation using active sound elements, the method comprising:

establishing a defined boundary or barrier location as a barrier;

mounting a passive sound absorbing layer at or near the boundary location;

receiving a transducer output corresponding to sound occurring within an area adjacent or close to the barrier;

using a single or a plurality of frequency-selective filters to provide outputs corresponding to frequency segments of the received transducer output at frequencies of respective ones of the frequency-selective filters, using, as the single or plurality of frequency-selective filters, filter circuits comprising $n^2$ parallel L-C circuits, the parallel L-C circuits configured to decompose an input voltage time series into $n^2$ predetermined frequency components, wherein n is an integer value, the $n^2$ pre-determined frequency components providing the outputs from the frequency-selective filters to an active driving circuit;

providing outputs from the frequency-selective filters to the active driving circuit and using the active driving circuit to generate one or more active noise reduction (ANR) driving output signals; and driving one or more output transducers with the ANR driving output signals at the barrier by placing at least a subset of said one or more output transducers at the barrier, adjacent the barrier or close to the barrier, to provide ANR at the frequencies of the frequency-selective filters, the one or more output transducers cooperating with the passive sound absorbing layer.

9. The method of sound attenuation of claim 8, further comprising:

providing at least one passive sound absorber at or close to the barrier.

10. The method of sound attenuation of claim 8, further comprising:

using, as the single or plurality of frequency-selective filters, filter circuits comprising a digital FFT processing circuit configured to decompose the input voltage time series into the $n^2$ predetermined frequency components, wherein n is an integer value, the $n^2$ predetermined frequency components providing the outputs from the digital FFT processing circuit to the active driving circuit.

11. The method of claim 8, further comprising:

driving one or more of the output transducers or metamaterial resonators at multiple frequencies.

12. The method of claim 8, further comprising:

driving one or more of the output transducers at a single discrete frequency component.

13. The method of sound attenuation of claim 8, further comprising:

locating the defined boundary or barrier location at or near a sound-absorbing surface, the sound-absorbing surface having one or more optimum sound absorption frequency ranges; and positioning at least a subset of the one or more output transducers at or near the sound-absorbing surface, wherein at least a subset the frequency-selective filters provide have resonant frequencies for frequency selection at a lower frequency than the optimum sound absorption frequency range of the sound-absorbing surface.

14. The method of sound attenuation of claim 8, further comprising:

locating a sound-absorbing surface located at or near the defined boundary location, the sound-absorbing surface comprising metamaterials and having one or more optimum sound absorption frequency ranges; and positioning at least a subset of the plurality of the one or more output transducers at or near the sound-absorbing surface, wherein at least a subset the frequency-selective filters provide have resonant frequencies for frequency selection at a lower frequency than the optimum sound absorption frequency range of the sound-absorbing surface.

15. An active sound barrier comprising:

a defined boundary or barrier location as a barrier;

passive sound absorbing means at or near the boundary or barrier location;

means to receive a transducer output corresponding to sound occurring within an area adjacent or close to the barrier;

a single frequency-selective filter or a plurality of frequency-selective filters to provide outputs corresponding to frequency segments of the received transducer output at frequencies of respective ones of the frequency-selective filters, the single or plurality of frequency-selective filters comprising filter circuits comprising $n^2$ parallel L-C circuits, the parallel L-C circuits configured to decompose an input voltage time series into $n^2$ predetermined frequency components, wherein n is an integer value, the $n^2$ pre-determined frequency components providing the outputs from the frequency-selective filters to an active driving circuit;

means to provide outputs from the frequency-selective filters to the active driving circuit and using the active driving circuit to generate one or more active noise reduction (ANR) driving output signals; and means to drive one or more output transducers with the ANR driving output signals at the barrier by placing at least a subset of said one or more output transducers at the barrier, adjacent the barrier or close to the barrier, to provide ANR at the frequencies of the frequency-selective filters, the output transducers cooperating with the passive sound absorbing means.

16. The active sound barrier of claim 15, further comprising:

the means to drive one or more output transducers driving one or more of the output transducers at multiple frequencies, or the means to drive one or more output transducers driving one or more of the output transducers at a single discrete one of predetermined frequency components.

17. The active sound barrier of claim 15, further comprising:

a sound-absorbing surface forming part of the active sound barrier, the sound-absorbing surface having one or more optimum sound absorption frequency ranges; and at least a subset of the one or more output transducers positioned at or near the sound-absorbing surface, wherein at least a subset the frequency-selective filters provide have resonant frequencies for frequency selection at a lower frequency than the optimum sound absorption frequency range of the sound-absorbing surface.

* * * * *